United States Patent [19]

Capuano

[11] 4,017,929

[45] Apr. 19, 1977

[54] DEVICE FOR PRESSING LOUIS SHOE HEELS

[75] Inventor: Antonio Capuano, Vigevano, Italy

[73] Assignee: SIGMA S.p.A., Vigevano, Italy

[22] Filed: Apr. 1, 1976

[21] Appl. No.: 672,667

[30] Foreign Application Priority Data

Apr. 18, 1975 Italy ..... 22502/75

[52] U.S. Cl. ..... 12/16.4

[51] Int. Cl.[2] ..... A43D 63/00

[58] Field of Search ..... 12/16.1, 16.4, 16.2, 12/16.3

[56] References Cited

UNITED STATES PATENTS 3,121,241 2/1964 Gulbrandsen ..... 12/16.4

3,550,175 12/1970 Downing et al. ..... 12/16.4

*Primary Examiner*—Patrick D. Lawson

*Attorney, Agent, or Firm*—Amster & Rothstein

[57] ABSTRACT

A device for pressing Louis shoe heels is provided comprising a lever pivotally mounted on the press cushion and carrying at the point of application of the load the usual felt pad or the like intended to be applied against the outer periphery of the heel and subjected to the action of an actuator at the point of application of the effort.

The lever can be turned over in order to bring the device in an inoperative position wherein it no longer interferes with the operator.

8 Claims, 2 Drawing Figures

DEVICE FOR PRESSING LOUIS SHOE HEELS

This invention relates to a device for pressing Louis shoe heels, which is mounted on presses for cementing soles to shoes.

The Louis heel shoes have a very irregular shape of the lower surface thereof. As a matter of fact, these shoes have a fore surface substantially flat corresponding to the foot sole, a shoe waist more or less deep at the center and a surface substantially perpendicular to the first one (more or less inclined according to the shape and the height of heel) and corresponding to the heel breast. In order to cement the shoe sole to the latter portion of the heel a pushing force in a horizontal plane must be exerted. This pushing force is attained by means of hydraulic actuators which are rigidly fastened on the press cushions and to the ends of which a resilient means is fastened which presses the heel against the rubber blocks forming the cushion, thereby obtaining the cementing of sole to heel.

All the prior art devices of this kind are cumbersome; they are long-sized and therefore the operator is compelled to work far from the press cushion, thereby making it more difficult and hard the positioning operation of the shoe on the cushion. Furthermore, when the press is used for pressing flat shoes, the device continues to interfere with the operator work since it is rigidly fastened on the cushion.

The object of this invention is to provide a device for pressing Louis shoe heels, which is less cumbersome than the known devices and which can be brought in an inoperative position when it is not used so that it can no longer interfere with the operator work when the press is used for pressing flat shoes.

More particularly, the heel pressing device in accordance with the invention is characterized in that it comprises a lever pivotally mounted on the press cushion and carrying at the point of application of the load the usual felt pad or the like intended to be applied against the outer periphery of the heel and subjected to the action of an actuator at the point of application of the effort.

According to a feature of the invention the pivot pin of the lever is supported by a fork fastened to a second pivot pin which is mounted on the press cushion and which can be brought from a working position to a rest position of said lever, in which the lever is turned over with respect to the working position and clears the region corresponding to the shoe heel.

According to another feature of the invention the pivot pin of the lever is removably supported by the fork on the press cushion so that it is possible for the heel pressing lever to be removed from the press.

Figure 1:
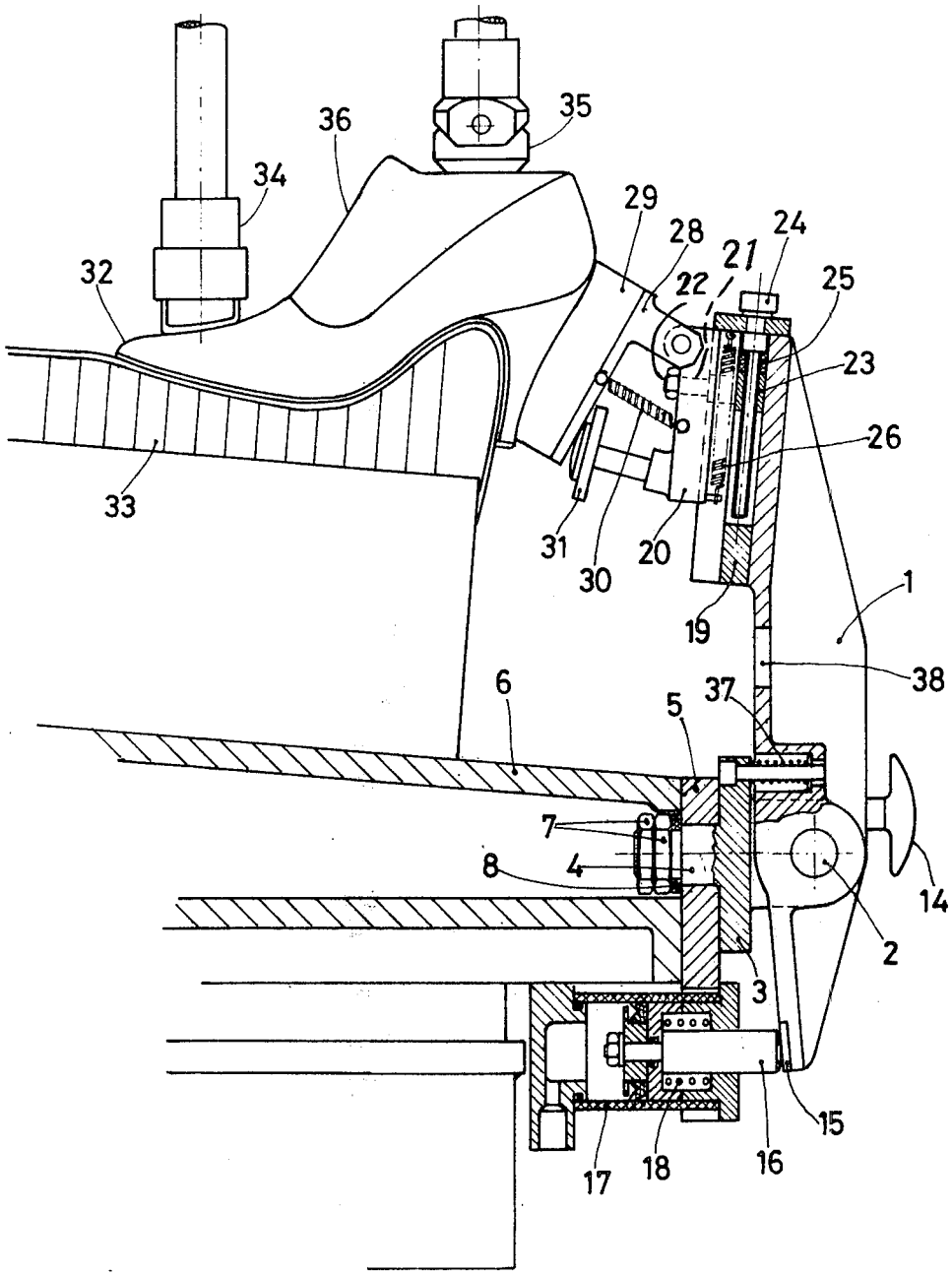
Figure 2:
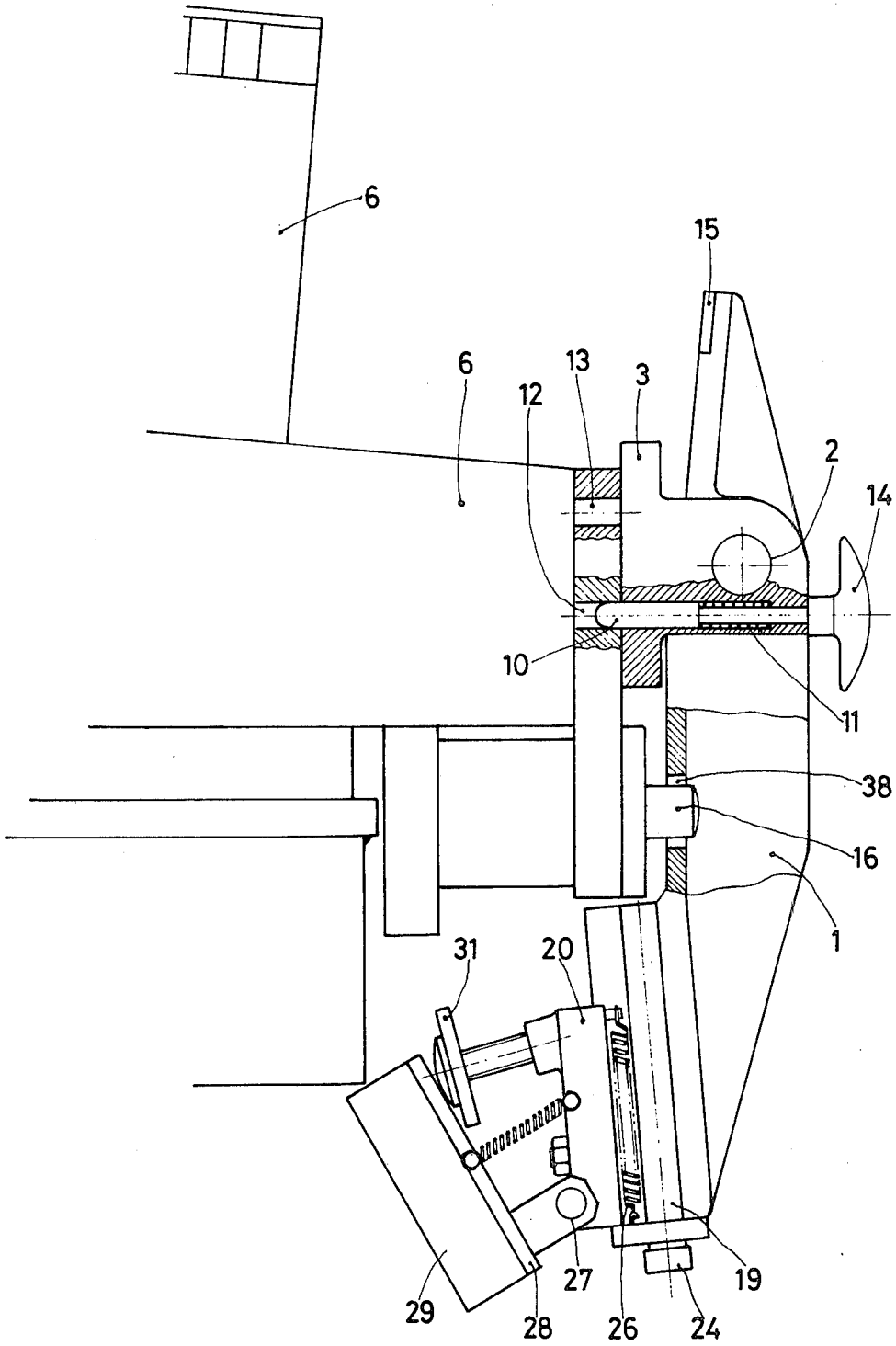

These and other features of the invention will be readily apparent from the following detailed description, given merely by way of example, and therefore not intended in limiting sense, of an embodiment thereof taken in connection with the accompanying drawings, wherein:

FIG. 1 is a side elevation view, partially cut away, of a heel pressing device according to the invention shown in a working position; and FIG. 2 is a side elevation view, partially cut away, of the device of FIG. 1, turned over in a rest position, with some portions of the press shown in FIG. 1 omitted for the sake of clarity.

Referring first to FIG. 1, there is seen that the heel pressing device is comprised of a lever 1 pivotally mounted on a pivot pin 2 supported by a fork fastened to a support member 3. Projecting from this support member 3 is a cylindrical stem 4 having a threaded end portion of smaller diameter and which is inserted in a hole provided in a plate 5 fastened to the cushion 6 of the press so as to permit the support member 3 to be fastened to the plate 5 by means of two nuts 7 and a washer 8. The washer 8 abuts the step formed between the two protions of the stem 4 of different diameter and provides the axial clearance necessary to permit the rotational movement of the support member 3 relative to the plate 5. This rotational movement of the support member is provided in order that the support member 3 and therefore also the lever 1 pivotally mounted thereon can assume two fixed positions, that is a working position and a rest position, as described in more detail hereinafter. To lock the support member in the two above mentioned positions a positioning pin 10 is provided, which, under the biasing of a spring 11, enters one of the seats 12 and 13 provided in the plate 5, said positioning pin being operated by means of a knob 14.

The lever 1 carries at one end a hardened steel plate 15 which, as the lever 1 is in a working position in FIG. 1, faces a stem 16 of a hydraulic cylinder 17. This cylinder is a singleacting cylinder and when it is not pressurized, the stem 16 is retracted by a spring 18.

At the other end of the lever 1 a guide means 19 is formed in which a heel pressing slide 20 slides. This slide carries a threaded pin 21 fastened thereto by means of a nut 22 and having a sleeve portion 23 through which a shank of an adjusting screw 24 estends. A threaded busing 25 which is prevented from rotating, engages the adjusting screw shank, thereby acting as a stop member for the sleeve portion 23. Tension springs 26 pull at all time the slide 20 upwardly so as to hold the sleeve portion 23 in abutment with the stop member 25. By turning the adjusting screw 24 the stop member 25. By turning the adjusting screw 24 the stop member 25 which is prevented from rotating, is screwed more or less on the threaded shank of the adjusting screw 24, thereby moving in either direction the sleeve portion 23 and therefore the slide 20. On the slide 20, a plate 28 is pivotally mounted by means of a pin, which plate 28 carries a felt pad 29 and is subjected at all time to the force of a return spring 30 which holds the plate 28 in abutment with an adjusting ring nut 31 having a threaded stem screwed in the slide 20. By screwing more or less the ring nut 31 in the slide 20 the slope of the felt pad 29 is changed so as to adapt it to the slope of the shoe heel.

The device heretofore described operates as follows:

After the shoe 32 is placed on the rubber blocks 33 of the cushion 6 and the lever 1 is set in the working position shown in FIG. 1, the height and shape of the felt pad 29 are adjusted by means of the adjusting screw 24 and the ring nut 31 so as to adapt the felt pad to the heel contour.

Then, the press is actuated and the lever 1, which is pushed by the stem 16 of the cylinder 17, presses the felt pad 29 against the shoe heel just before the cylinder of the press pushes the cushion 6 carrying the shoe against stop members 34 and 35 of the press. This operative sequence is obtained by controlling the speed of movement of the piston 16 by means of a flow regulator, not shown, without the upstroke speed of the press cylinder being changed. Therefore, there is no loss of time due to the need to slowdown the upstroke of the press cylinder through a flow regulator or by other means in order to coordinate the cushion movement to the heel pressing device movement.

As the shoe 32 with the last 36 inserted therein abuts the fixed stop members 34 and 36 of the press, the shoe squeezes the rubber blocks 33 of the cushion and lowers with respect to the frame of the cushion. During this movement the shoe lowers also the felt pad 29 which in turn lowers the slide 20 thereby putting the return spring 26 under tension. In this manner no relative movement between the shoe heel and the felt pad 29 occurs so that the heel is always supported and pressed against the shoe sole.

At the end of the cementing cycle, just after the press cushion has begun to lower, the lever 1 no longer retained in engagement with the piston 16 which in the meantime has been retracted, is rotated by the spring 37 in a clockwise direction so that the felt pad 29 is moved away from the shoe heel and the press is ready to begin another working cycle.

When Louis heel shoes are not to be pressed, the pin 10 is removed from the seat 13 by pulling the knob 14, the lever 1 is rotated by 180° about the axis of the pivot pin 4 until the lever is in the position shown in FIG. 2 wherein the heel pressing device will no longer interfere with the press cushion which now can be used for pressing conventional shoes. To prevent the piston 16 of the cylinder 17 from interferring with the lever 1 in the turned over position, a hole 38 for receiving the piston 16 is provided in the lever. Thus, it is not necessary for the piston 16 to be disconnected from the hydraulic circuit or otherwise locked as the heel pressing device is inoperative. In the new position shown in FIG. 2, the lever 1 can be locked by releasing the knob 14 so that the pin can enter the new seat 12.

Therefore, the region corresponding to the shoe heel is completely clear for the operator and he can work near the cushion in order to position a conventional shoe in spite of the presence on the press of the heel pressing device for the Louis shoes which is now in an inoperative position as it is not used in working conventional shoes.

The heel pressing device can be even removed from the press, if desired. To this purpose it will be sufficeint to pull out the pivot pin 2 and remove the lever 1.

While a single embodiment of the invention has been described and illustrated, it is obvious that various changes and modifications can be made without departing from the scope of this invention.

What I claim is:

1. A device for pressing Louis shoe heels mounted on a cushion press for cementing soles to shoes comprising a lever having pivotal mounting on said cushion press;

said lever having a first part extending longitudinally in one direction from said pivotal mounting and including a pad mounted at the end thereof for applying pressure against the heel;

said lever having a second part extending longitudinally in the opposite direction from said pivotal mounting to terminate in an end portion; and pressure means located on said cushion press to apply pressure against said end portion to provide a first rotational movement of said lever whereby said pad is pressed against the heel.

2. A device according to claim 1 in which said pivotal mounting comprises a pin extending generally horizontally and transverse to said longitudinal extensions of said lever, said pin being rotatably mounted within a support member that is mounted on said cushion press, the mounting of said support member comprising a rotatable stem extending generally horizontally and transverse to said pin extension to provide a second rotational movement of said lever transverse to said first rotational movement, said second rotational movement allowing said lever to move from a working position to a rest position.

3. A device according to claim 1 in which said pin is removable from said support member to provide detachment of said lever from said cushion press.

4. A device according to claim 1 in which a pair of depressions are formed in said cushion press opening outwardly toward said lever and positioned respectively above and below said pivot pin, a positioning pin is mounted in said lever to be generally horizontally slidable under a biasing pressure toward said depressions, said positioning pin so located as to be receivable in lockable relation in one of said depressions when said lever is in said working position and receivable in locakable relation in the other said depression when said lever is in said rest position.

5. A device according to claim 1 in which said pressure means comprises a hydraulically actuated stem, and an opening is formed in said lever for receiving said hydraulically actuated stem when said lever is in said rest position.

6. A device according to claim 1 in which said pad includes a first section that is pivotally mounted on a slide member, said pad includes a second section spaced from said first section and in contact with a longitudinally extending element mounted on said slide member, and a spring is connected between said pad and said slide member to bias said pad against said element.

7. A device according to claim 6 in which said element connected to said slide member is adjustable along its longitudinal extension to provide a change in angle relationship between said pad and said slide member.

8. A device according to claim 6 in which said slide member includes an adjustable sleeve to which said pad is connected, said sleeve movable longitudinally within said slide member to adjust the vertical height of said pad with respect to the heel.

* * * * *